US008830084B2

(12) United States Patent
Huppertz

(10) Patent No.: US 8,830,084 B2
(45) Date of Patent: Sep. 9, 2014

(54) DEVICE AND METHOD FOR ACTIVATING A HORN OF A MOTOR VEHICLE, MOTOR VEHICLE AND ALARMING SYSTEM

(75) Inventor: Guido Huppertz, Kall (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 329 days.

(21) Appl. No.: 13/187,835

(22) Filed: Jul. 21, 2011

(65) Prior Publication Data

US 2011/0291858 A1 Dec. 1, 2011

Related U.S. Application Data

(63) Continuation of application No. PCT/EP2010/050226, filed on Jan. 11, 2010.

(30) Foreign Application Priority Data

Jan. 22, 2009 (DE) ..... 10 2009 005 627

(51) Int. Cl.
*G08G 1/00* (2006.01)
*G08B 27/00* (2006.01)

(52) U.S. Cl.
CPC ..... *G08B 27/00* (2013.01)
USPC ..... 340/901; 340/540

(58) Field of Classification Search
USPC ..... 340/901
See application file for complete search history.

(56) References Cited

U.S. PATENT DOCUMENTS

| | | | | |
|---|---|---|---|---|
| 4,305,070 | A * | 12/1981 | Samuel | 340/691.8 |
| 5,781,852 | A * | 7/1998 | Gropper | 455/227 |
| 6,112,075 | A | 8/2000 | Weiser | |
| 7,319,382 | B1 | 1/2008 | Vu | |
| 2006/0273884 | A1 * | 12/2006 | Watkins et al. | 340/425.5 |
| 2007/0252688 | A1 | 11/2007 | Eisold et al. | |
| 2007/0296575 | A1 | 12/2007 | Eisold et al. | |
| 2009/0001730 | A1 | 1/2009 | Kuo et al. | |
| 2010/0164719 | A1 * | 7/2010 | George et al. | 340/541 |

FOREIGN PATENT DOCUMENTS

| | | | |
|---|---|---|---|
| DE | 1 939 272 | A | 2/1971 |
| DE | 94 18 790 | U1 | 3/1995 |
| DE | 199 15 545 | A1 | 10/2000 |
| DE | 10 2004 044 220 | A1 | 4/2005 |
| EP | 1 239 435 | A2 | 9/2002 |
| WO | 01/13551 | A2 | 2/2001 |

OTHER PUBLICATIONS

English translation of Official Communication issued in corresponding International Application PCT/EP2010/050226, mailed on Aug. 25, 2011.
Official Communication issued in International Patent Application No. PCT/EP2010/050226, mailed on May 20, 2010.
English translation of Official Communication issued in corresponding German Patent Application No. 10 2009 005 627.0, mailed on Jun. 21, 2010.

* cited by examiner

*Primary Examiner* — Kerri McNally
(74) *Attorney, Agent, or Firm* — Keating & Bennett, LLP

(57) ABSTRACT

A device for activating a horn of a motor vehicle by a remote transmitter independent of a vehicle user includes a receiver and a control unit. The receiver is implemented to receive an activation signal from the remote transmitter. The control unit is implemented to activate the horn of the motor vehicle in response to the activation signal.

13 Claims, 10 Drawing Sheets

700

| bit | identification | content |
|---|---|---|
| 1 | alarm identification | 0 = no<br>1 = yes |
| 2-3 | information regarding extent | value 1-4:<br>predefined radii in km<br>e.g. 10/25/50/125 |
| 4 | correction bit | 0 = no<br>1 = yes |
| 5-14 | local adressing | $1024 = 2^{10}$ adresses definable, e.g. 936 cells and additionally 88 special areas (Federal States, special zones etc.) |

FIGURE 7

800 first pass: X-coordinate, group of radii

| bit | identification | content |
|---|---|---|
| 1 | alarm identification | 0 = no<br>1 = yes |
| 2 | indication regarding group of radii | value 1-2:<br>e.g. group of radii 1:10 or 15 km |
| 3-14 | local adressing | $4096 = 2^{12}$ X-positions definable<br>e.g. 4000 regular X grid values plus 96 further defined values |

second pass: Y-coordinate, radius

| bit | identification | content |
|---|---|---|
| 1 | alarm identification | 0 = no<br>1 = yes |
| 2 | indication regarding group of radii | 0 = radius 1 from the group<br>1 = radius 2 from the group<br>e.g. bit = 0 → radius = 10 |
| 3-14 | local adressing | $4096 = 2^{12}$ Y-positions definable<br>e.g. 4000 regular Y grid values plus 96 further defined values |

FIGURE 8

900

| bit | identification | content |
|---|---|---|
| 1 | alarm | 0 = no<br>1 = yes |
| 2-5 | module type (e.g. car, truck, emergency services, authorities) | value 1-4 |
| 6 | GSM activation | 0 = no<br>1 = yes |
| 7 | GPS activation | 0 = no<br>1 = yes |
| 8 | signaller activation | 0 = no<br>1 = yes |
| 9 | check vehicle state | 0 = no<br>1 = yes |
| 10 | activation RDS radio | 0 = no<br>1 = yes |
| 11 - 12 | time of resolution in t+x minutes | value 1-4 |
| 13 - 14 | free | not yet defined |

FIGURE 9

1000

| bit | identification | content |
|---|---|---|
| 1-93 | alarming and coordinates | ASCII-character code |

FIGURE 10

DEVICE AND METHOD FOR ACTIVATING A HORN OF A MOTOR VEHICLE, MOTOR VEHICLE AND ALARMING SYSTEM

CROSS-REFERENCE TO RELATED APPLICATIONS

This application is a continuation of copending International Application No. PCT/EP2010/050226, filed Jan. 11, 2010, which is incorporated herein by reference in its entirety, and additionally claims priority from German Application No. DE 102009005627.0, filed Jan. 22, 2009 which is incorporated herein by reference in its entirety.

BACKGROUND OF THE INVENTION

Embodiments of the present invention relate to a device and a method for activating a horn of a motor vehicle by a remote transmitter independent of a motor vehicle user, to a motor vehicle and an alarm system or warning system having a wake-up effect based on motor vehicle honks.

As a consequence of a comprehensive disassembly and reassembly of sirens after 1992, for example in Germany an extensive warning system with a wake-up effect to be used for warning the civilian population no longer exists. Of the originally existing 87,000 sirens (ES) in 1992, only approx. 15,000 of 39,000 remaining sirens were still operable for alarming the population in 2000. A technical modification of existing sirens into civilian protection signals and an additional new assembly of a siren system is discarded in a study commissioned by the BBK (Bundesamt für Bevölkerungsschutz and Katastrophenhilfe; Federal Agency for the Protection of the Population and Emergency Aid) of the market-leading siren manufacturer Hörmann GmbH, Kirchseeon, due to the projected costs of approx. 250 million €. ("Technologische Möglichkeiten einer möglichst frühzeitigen Warnung der Bevölkerung", BMI, Reihe Zivilschutzforschung, Vol. 45, 2001).

The federal states and the federal agency BBK responsible for civil defense (e.g. in Germany) think such a warning system with a wake-up effect is needed, however.

A comprehensive solution for providing a warning system with a wake-up effect does not currently exist (in Germany). The current warning technology is an insufficient remaining stock of installed sirens. Different approaches have been examined since the end of the nineties, like, for example, alarming the population by:

1. SMS
2. telephone (landline or mobile)
3. radio-controlled alarm clocks and watches
4. smoke detectors
5. doorbells
6. rebuilding of a siren network These proposals show more or less severe disadvantages and/or may not be implementable. The effectivity of some warning technologies is insufficient or doubtful (1.-5.) or the costs are too high for the state (6.).

Alarming by mass SMS was already rejected in 2003 as mobile radio technology is not suitable for such capacities. Tests had indicated that it took up to 24 hours to warn 50,000 residents of a city by SMS.

The highest technical supply rate without reassembly of a siren network is achieved via the telephone, which may also have a wake-up effect. However, there are increasingly less connections to the landline network in favor of mobile telephony, wherein this technology is not construed for such capacities. Landline telephony basically has the needed capacity for handling several thousands of conversations simultaneously. However, in this respect the installation of alarm computers in the telephone switchboards is needed. The costs for this are estimated to be approx. 200 million Euros.

More than 230 million Euros were already calculated years ago for the reassembly of the disassembled siren network.

The radio-controlled clock transmitter DCF77 is also capable to transmit warnings since 2006. The connections to the satellite-aided warning system SatWaS are available. However, large parts of the population have no radio-controlled clocks or alarm clocks.

Also a plurality of the TV and radio stations are connected to SatWaS (also in connection with RDS and DAB) and some interne providers who can correspondingly distribute current warnings. However, these media only reach active users and have no wake-up effect.

Further examples and a detailed explanation with respect to the underlying technical problems and the above-mentioned hitherto thought-out and discarded concepts may, for example, be found under http://www.bbk.bund.de/cln 027/nn 399436/DE/02 Themen/11 Zivilschutztechnik/04 Warnsyst/02 Entwick./Entwick1 node.html nnn=true, in the study "Problemstudie: Risiken für Deutschland, Teil1, Hrsg. BBK, AKNZ, 2005" to be found under http://www.bbk.fund.de/nn402296/SharedDocs/Publikationen/Wissenschaftsforum/Risikenfuer-D Teil1, templateld=raw.property=publicationFile.pdf/Risikenfuer-D Teil 1.pdf, in the study "Technische Möglichkeiten einer möglichst frühzeitigen Warnung der Bevölkerung Kurzfassung, BMI, Zivilschutzforschung, Neue Folge Band 45, 2001" to be found under http://www.bbk.bund.de/cln007/nn400298/SharedDocs/Publikationen/Publikationen 20 Forschung/Band2045, templateld=raw.property=publicationFile.pdf/Band %2045.pdf, in the study "Neue Strategie zum Schutz der Bevölkerung in Deutschland" im Kapitel "Ressourcen, Fähigkeiten and Defizite in der Gefahrenvorsorge und—abwehr, MI, Zentralstelle für Zivilschutz, Schriftenreihe WissenschaftForum, Band 4, 2002" to be found under http://www.bbk.bund.de/cln027/nn398732/SharedDocs/Publikationen/Wissenschaftsforum/B and-4 Neue Strategie.templateld=raw.property=publicationFile.pdf/Band-4 Neue Strategie.pdf, under "ZEIT v. 01.11.2007: "Warnsysteme: Aufwachen!", http://www.zeit.de/2007/45/T-Warnsysteme.", under "STERN v. 13.11.2007: "Katastrophenschutz: Das unerwünschte Schweigen der Sirenen", http://www.stern.de/computer-technik/technik/:Katastrophenschutz-Das-Schweigen-Sirenen/602513.html", under "HEISE v. 12.05.2008: "Die Rückkehr der Sirenen", http://www.heise.de/newsticker/Die-Rueckkehr-der-Sirenen-/meldung/107742" and under "BERLINER ZEITUNG v. 18.01.2005: Sirene im Wohnzimmer", http://www.berlinonline.de/berliner-zeitung/archiv/bin/dump.fcgi/2005/0118/wissenschaft/0017/index.html".

SUMMARY

According to an embodiment, a device for activating a horn of a motor vehicle by a remote transmitter independent of a motor vehicle user may have a receiver which is implemented to receive an activation signal from the remote transmitter; and a control unit which is implemented to activate the horn of the motor vehicle in response to the activation signal, wherein the control unit is implemented to determine whether the motor vehicle is parked, and is implemented to only activate the horn of the motor vehicle when the motor vehicle is parked, or the control unit is implemented, in response to the activation signal, to determine a position of the motor vehicle and, based on a comparison of alarming area information and the position of the motor vehicle, to activate the horn of the motor vehicle, wherein the alarming area information is contained in the activation signal or in an alarming area information signal.

According to another embodiment, a motor vehicle having a device for activating a horn of a motor vehicle by a remote transmitter independent of a motor vehicle user may have a receiver which is implemented to receive an activation signal from the remote transmitter; and a control unit which is implemented to activate the horn of the motor vehicle in response to the activation signal, wherein the control unit is implemented to determine whether the motor vehicle is parked, and is implemented to only activate the horn of the motor vehicle when the motor vehicle is parked, or the control unit is implemented, in response to the activation signal, to determine a position of the motor vehicle and, based on a comparison of alarming area information and the position of the motor vehicle, to activate the horn of the motor vehicle, wherein the alarming area information is contained in the activation signal or in an alarming area information signal.

According to another embodiment, an alarming system may have a motor vehicle having a device for activating a horn of a motor vehicle by a remote transmitter independent of a motor vehicle user, which may have a receiver which is implemented to receive an activation signal from the remote transmitter; and a control unit which is implemented to activate the horn of the motor vehicle in response to the activation signal, wherein the control unit is implemented to determine whether the motor vehicle is parked, and is implemented to only activate the horn of the motor vehicle when the motor vehicle is parked, or the control unit is implemented, in response to the activation signal, to determine a position of the motor vehicle and, based on a comparison of alarming area information and the position of the motor vehicle, to activate the horn of the motor vehicle, wherein the alarming area information is contained in the activation signal or in an alarming area information signal; a remote transmitter which is implemented to transmit the activation signal; and a control center which is implemented to control the transmission of the activation signal by the remote transmitter.

According to another embodiment, a method for activating a horn of a motor vehicle by a remote transmitter independent of a vehicle user may have the steps of receiving an activation signal from the remote transmitter; either determining, whether the motor vehicle is parked, or determining a position of the motor vehicle in response to the activation signal; and activating the horn of the motor vehicle either in response to the activation signal and only when the motor vehicle is parked, or in response to the activation signal and based on a comparison of alarming area information and the position of the motor vehicle, wherein the alarming area information is contained in the activation signal or in an alarming area information signal.

According to another embodiment, a computer program may have a program code for executing the method for activating a horn of a motor vehicle by a remote transmitter independent of a vehicle user, wherein the method may have the steps of receiving an activation signal from the remote transmitter; either determining, whether the motor vehicle is parked, or determining a position of the motor vehicle in response to the activation signal; and activating the horn of the motor vehicle either in response to the activation signal and only when the motor vehicle is parked, or in response to the activation signal and based on a comparison of alarming area information and the position of the motor vehicle, wherein the alarming area information is contained in the activation signal or in an alarming area information signal, when the computer program is executed on a computer or microcontroller.

One embodiment according to the invention provides a device for activating the horn of a motor vehicle by a remote transmitter, independent of the motor vehicle user, which comprises a receiver and a control unit. The receiver is implemented to receive an activation signal from the remote transmitter. The control unit is implemented to activate the horn of the motor vehicle in response to the activation signal.

Embodiments according to the invention are based on the central idea of using the horns of motor vehicles for warning the civilian population in case of an alarm. The only requisite needed for this is a receiver in the motor vehicle for receiving an activation signal and a control unit for activating the horn of the motor vehicle if needed.

As a horn and also a car battery for power supply are already present in every motor vehicle, the additional effort for realizing the warning system is limited to the receiver and the control unit. Thus, a simple and cost-effective realization of a warning system for the population is possible.

Additionally, by the use of the horn, high effectivity may be achieved by the pronounced wake-up effect of the horns of motor vehicles. In other words, by the activation of the horn of a motor vehicle, the attention of the population in the environment of the motor vehicle can be easily aroused.

In addition, for example, high availability may be achieved even without every motor vehicle having the described device, as the signals can be heard over long distances. This means that the setup phase could also be kept short if only new motor vehicles were to be equipped with the system. Thus, within a very short time, there could be enough vehicles to guarantee a nationwide warning system.

Further, the described concept is independent of the power supply system. This means that a warning or alarming of the population can be guaranteed, even when the power supply fails.

Additionally, the system is virtually maintenance-free during its expected useful life (until a new vehicle is bought), and thus no specific maintenance costs result.

Further, the system can be adapted with little effort as a continuous exchange takes place by new motor vehicles being bought.

Some embodiments according to the invention relate to a device for activating the horn of a motor vehicle, wherein the control means is implemented, based on a vehicle state and/or a position of the vehicle, to activate the horn of the motor vehicle. For example, activating the horn may be limited to parked vehicles. On the other hand, it is possible to warn and alarm only the population of a certain region or a certain area, so that only the horns of motor vehicles in this area are to be activated.

Some further embodiments according to the invention relate to an alarming system or warning system which comprises a plurality of motor vehicles each having a device for activating the horn of the motor vehicle, a control center and the transmitter. For example, the information the activation signal is to contain is determined by the control center and the transmission of the activation signal is controlled by the transmitter.

BRIEF DESCRIPTION OF THE DRAWINGS

Embodiments according to the invention are explained in more detail in the following with reference to the accompanying drawings, in which:

FIG. 7 is a table with an encoding scheme for using the DCF77 transmitter with a coarse grid structure;

FIG. 8 is a table with an encoding scheme for using the DCF77 transmitter with a fine grid structure;

FIG. 9 is a table with an encoding scheme for using the DCF77 transmitter and a GNSS and/or mobile radio module; and FIG. 10 is a table with an encoding scheme for using eCall modules (electronic call modules).

DETAILED DESCRIPTION OF THE INVENTION

Motor vehicles with a cylinder capacity of more than 50 $cm^3$ registered in Germany have to be equipped, for example, with a horn ("sound signal generator") according to the German StVZO, §55. The volume (maximum 105 dB at a distance of 7 meters) and the sound of the device are regulated within standardized limits nationwide.

The simultaneous blowing of the horns of all motor vehicles in one area on a massive scale would be heard during the day and night in all locations within the alarmed area in which vehicles are located. Due to a vehicle density of 599 motor vehicles/1000 inhabitants and an absolute number of registered motor vehicles (without trailers) of more than 50 million in Germany (43 million only cars, busses, trucks) (information according to the Federal Department of Motor Vehicles, dated Sep. 8, 2008), a high degree of coverage with regard to area is given by this approach, also in rural or sparsely populated areas, as well as a certain degree of coverage in dynamically used areas (sports and leisure facilities, parking spaces in hiking regions, etc.) which may otherwise be reached only partly or even not at all.

For example, in a study ordered by the Federal Ministry of the Interior (BMI) in the year 2001, a reachability of the population of 80% during the day and 45% during the night were named as international peak values. The proposed warning system is suitable for reaching or even exceeding these values.

Figure 2:
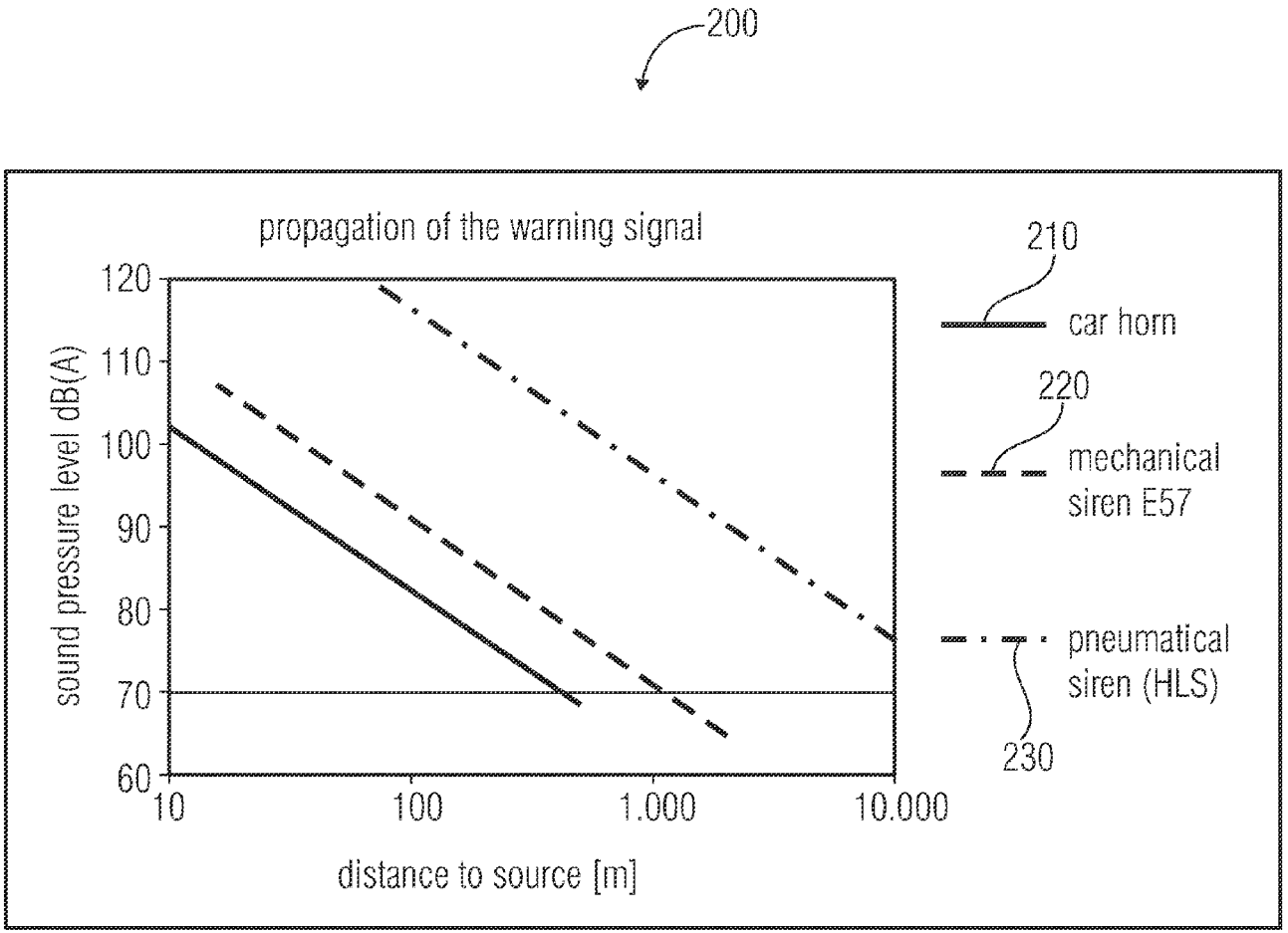
FIG. 2 is a diagram of "sound pressure level over distance to source"

The sirens with a mechanical or pneumatic design to be used as a comparison have theoretical signal ranges of approx. 1 km (mechanical) up to approx. 10 km (pneumatic) with respect to a threshold value of 70 dB(A). This approximately corresponds to the volume of a car passing at a distance of 10 meters (60-80 dB(A)). FIG. 2 accordingly shows the theoretical sound pressure levels as a function of the distance to the sound source.

The theoretical sound pressure level in decibels (A filter) when assuming ideal environmental conditions is illustrated in a logarithmic distance representation. The sound pressure level of a single vehicle (the honking or audible warning of one individual vehicle in each case) is less than that of a mechanical siren. The diagram 200 compares the sound pressure level of a horn of a motor vehicle 210 (car horn) to a mechanical siren of the E57 type 220 and a pneumatic siren 230 (HLS, high-performance siren).

Figure 3:
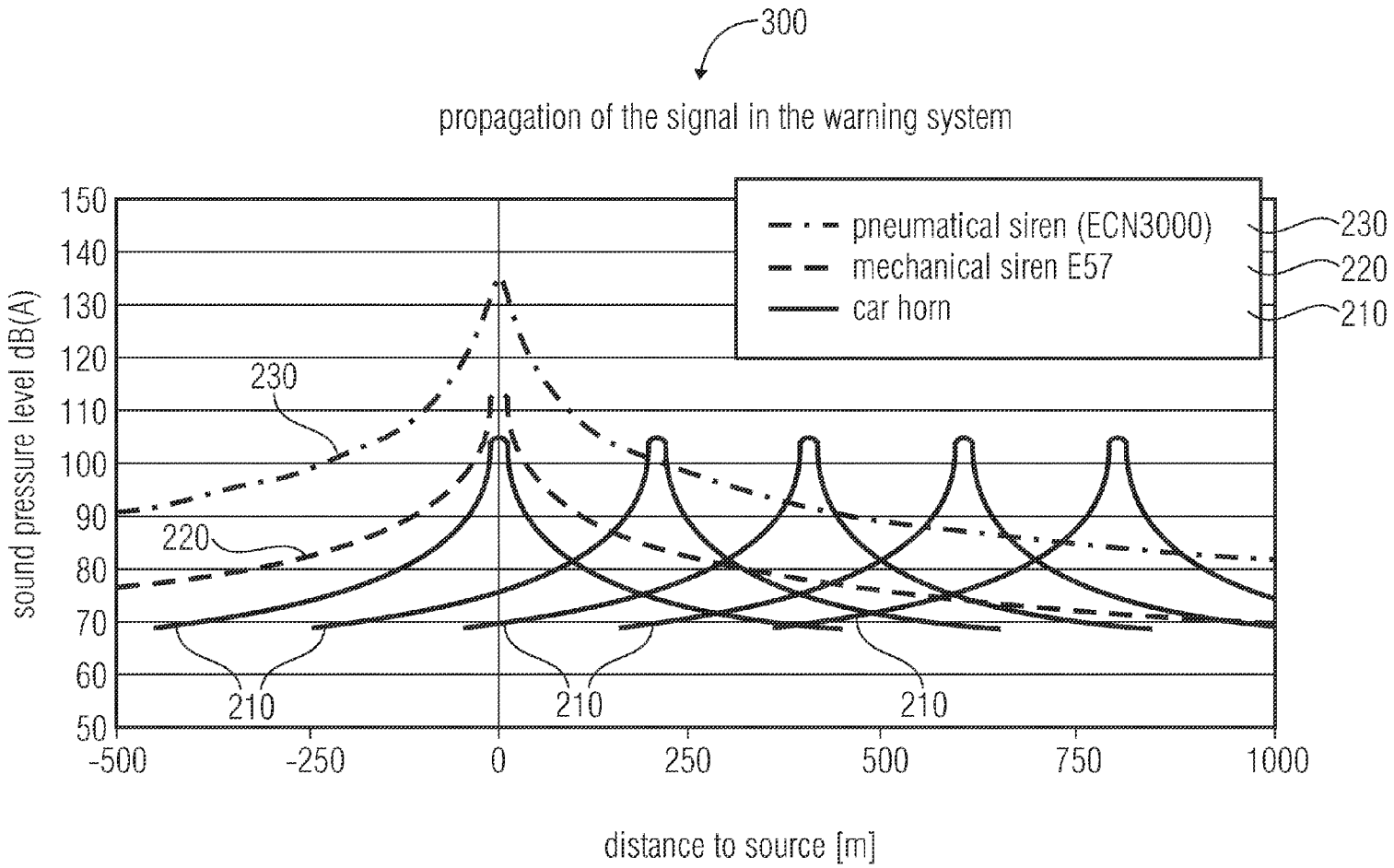
FIG. 3 is a diagram of "sound pressure level over distance to source"

In reality, this range may not be achieved due to environmental conditions (wind direction, temperature, ground consistency, building density, etc.) and ranges of 400-500 m (mechanical) and 1-2 km (electronic high-power sirens) are regarded as an effective limit of the signal. Using the same assessment criteria, e.g. using car horns, effective ranges of approx. 150 m are realistic. Due to the substantially higher density of motor vehicles with respect to siren locations in urban and rural regions, the technical degree of coverage of the warning system is to be classified as very high despite the low range of the individual sound sources. FIG. 3 again shows this effect with the stipulation of theoretical sound pressure levels. Considering real effects, the effectivity is shifted in favor of the described system.

The theoretical sound pressure level in decibels (A filter) when assuming ideal environmental conditions is illustrated. The theoretical sound propagation when alarming five vehicles at a distance of 200 m from each other is illustrated. The effective sound pressure level when alarming vehicles with an extensive distribution is already higher in the near range than that of mechanical sirens. The diagram 300 compares the sound pressure level of car horns 210 with that of mechanical sirens of the E57 type 220 and electronic sirens 230 (e.g. ECN3000).

In contrast to acoustic warning signals or signal signs of other devices, the use of which was considered or decided on as a replacement with respect to the new setup of a siren warning system, such as, e.g., telephones, doorbells or clocks with a wake-up function, the horns of motor vehicles not only distinguish themselves by volume and frequency but also with respect to their attention-arresting sociological importance. They are designed as safety-related means and are primarily used as such in contrast to the above-mentioned conventional commodities.

One difference between the new concept and other discussed proposals is that, apart from sirens, only the warning system proposed here may achieve real broadcast alarming, i.e. may reach a plurality of receivers (e.g. households) with one sound source.

Figure 1:
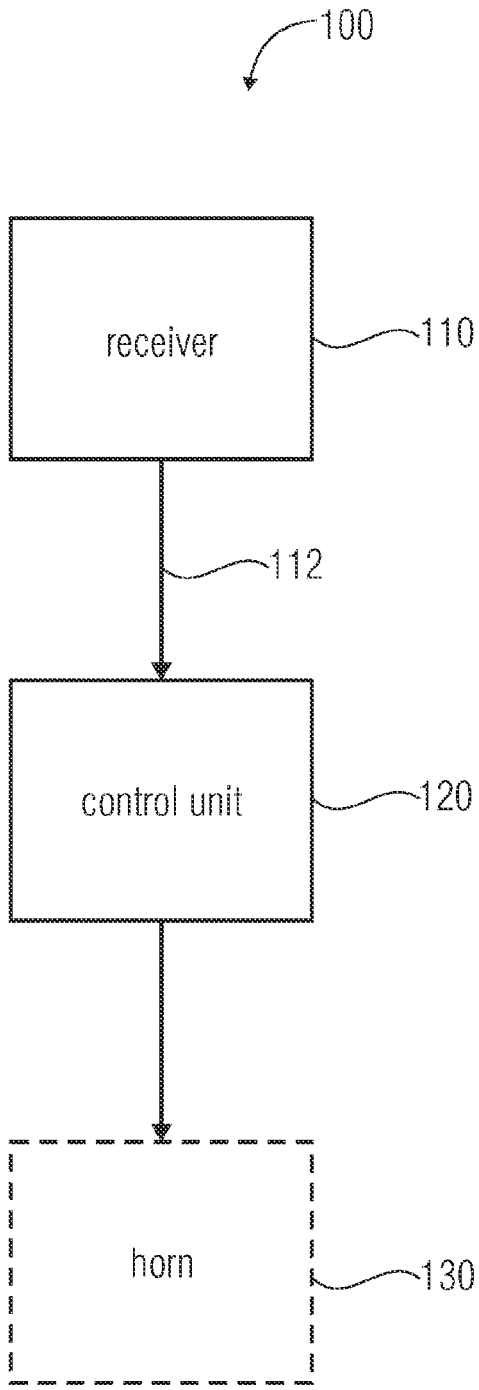
FIG. 1 shows a block diagram of a device for activating the horn of a motor vehicle.

FIG. 1 shows a block diagram of a device 100 for activating a horn or warning signal generator 130 of a motor vehicle by a remote transmitter independent of the vehicle user according to one embodiment of the invention. The device 100 includes a receiver 110 and a control unit 120. The receiver 110 receives an activation signal 112 from the remote transmitter. The control unit 120 activates the horn 130 of the motor vehicle in response to the activation signal 112.

As the horn 130 of a motor vehicle (car) may be heard across large distances, alarming with a wake-up effect may, for example, be realized with high effectivity. Here, a high coverage may be achieved due to a high number of vehicles per household. Further, the realization may be executed after a short setup phase, as for example the reproduction rate corresponds to approx. 10% of the overall number of vehicles per year.

By the integration of the described device for activating the horn 130 into motor vehicles, a high reliability of alarming may be achieved as the system is independent of the power network, may achieve high redundancy, as millions of motor vehicles exist, and achieve a high technical reliability as motor vehicles are regularly inspected or renewed.

On the other hand, there are low installation costs as many already existing components of a motor vehicle, such as, for example, the horn or the car battery for power supply are used and only the described device has to be additionally integrated. The pure additional expense might be negligible compared to the price of the vehicle and the system would need very low maintenance within the useful life to be expected.

Further, the system could easily be developed into an international solution. In addition, the system may be adapted with little effort, as a continuous exchange of the modules takes place by new cars being bought.

The effectivity of the use of the horn 130 of a vehicle may be illustrated, for example, in comparison with a siren system.

The activation of the horn 130 of the motor vehicle may, for example, be executed based on an alarm information, a vehicle state, alarming or alerting region information and/or a position of the vehicle.

The alarm information may, for example, be part of the activation signal and indicate, for example, whether an alarm exists and whether, for example, the alarm is only to be restricted to authority vehicles or other vehicle categories.

Further, it may, for example, be determined that the horn is only activated in vehicles which are parked. In this respect the vehicle state may be determined.

The alarming or alarm area information may, for example, be contained in the activation signal or be transmitted by a suitable alarming area information signal, for example to a mobile radio unit in the motor vehicle. The alarming area information may define a restricted area in which the alarm is to be triggered. For vehicles located outside this area, the horns are accordingly not to be triggered. In this respect, the alarming area information may be compared to a current or last known position of a vehicle and the horn may be activated depending on this comparison.

Figure 4:
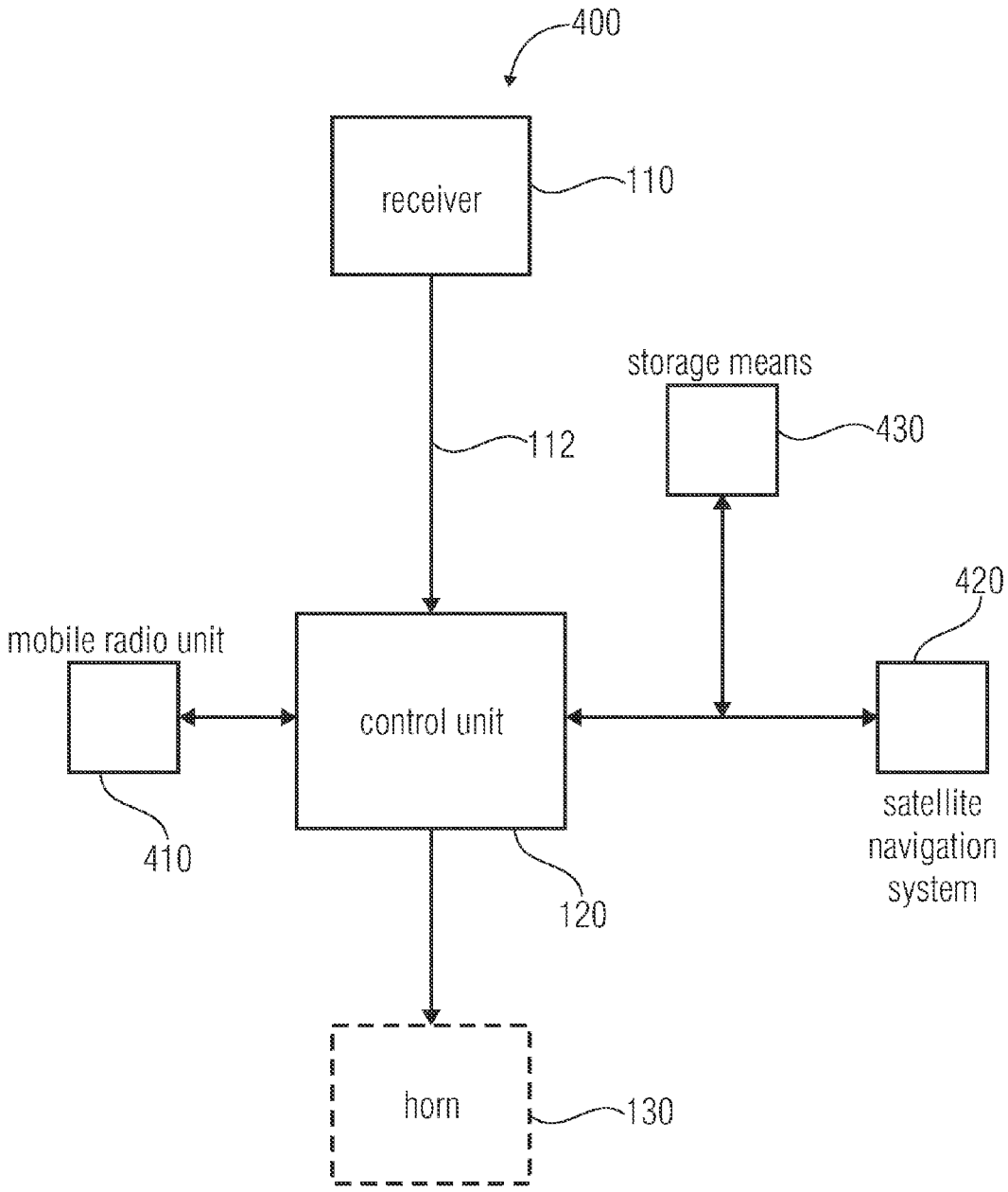
FIG. 4 is a block diagram of a device for activating the horn of a motor vehicle.

FIG. 4 shows a block diagram of a device 400 for activating the horn 130 of a motor vehicle by a remote transmitter independent of a vehicle user according to an embodiment according to the invention. The device includes the receiver 110, the control unit 120, a mobile radio unit 410, a satellite navigation system 420 and a memory means 430.

The receiver 110 is connected to the control unit 120 and receives the activation signal 112.

In response to the activation signal 112, the control unit 120 may, for example, activate the connected mobile radio unit 410 to receive additional information, like, e.g., area coordinates.

Further, the satellite navigation system 420 is connected to the control unit 120 and may be activated to determine the current location of the motor vehicle. Alternatively, the satellite navigation system 420 may provide a last known position of the vehicle of the connected memory means 430 for storage. The control unit 120 may call or fetch this stored last known position from the memory means 430. The memory means 430 is in this respect connected to the control unit 120 and the satellite navigation system 420.

Based on the activation signal 112, the additional information of the mobile radio unit 410 and the current position or the stored position of the vehicle and the state of the vehicle (e.g. vehicle parked), the control unit 120 may activate the horn 130 of the vehicle.

Alternatively, for example, the receiver 110 may also be a mobile radio receiver and part of the mobile radio unit 420 and the memory means 430 may be part of the control unit 120 or the satellite navigation system 420.

Figure 5:
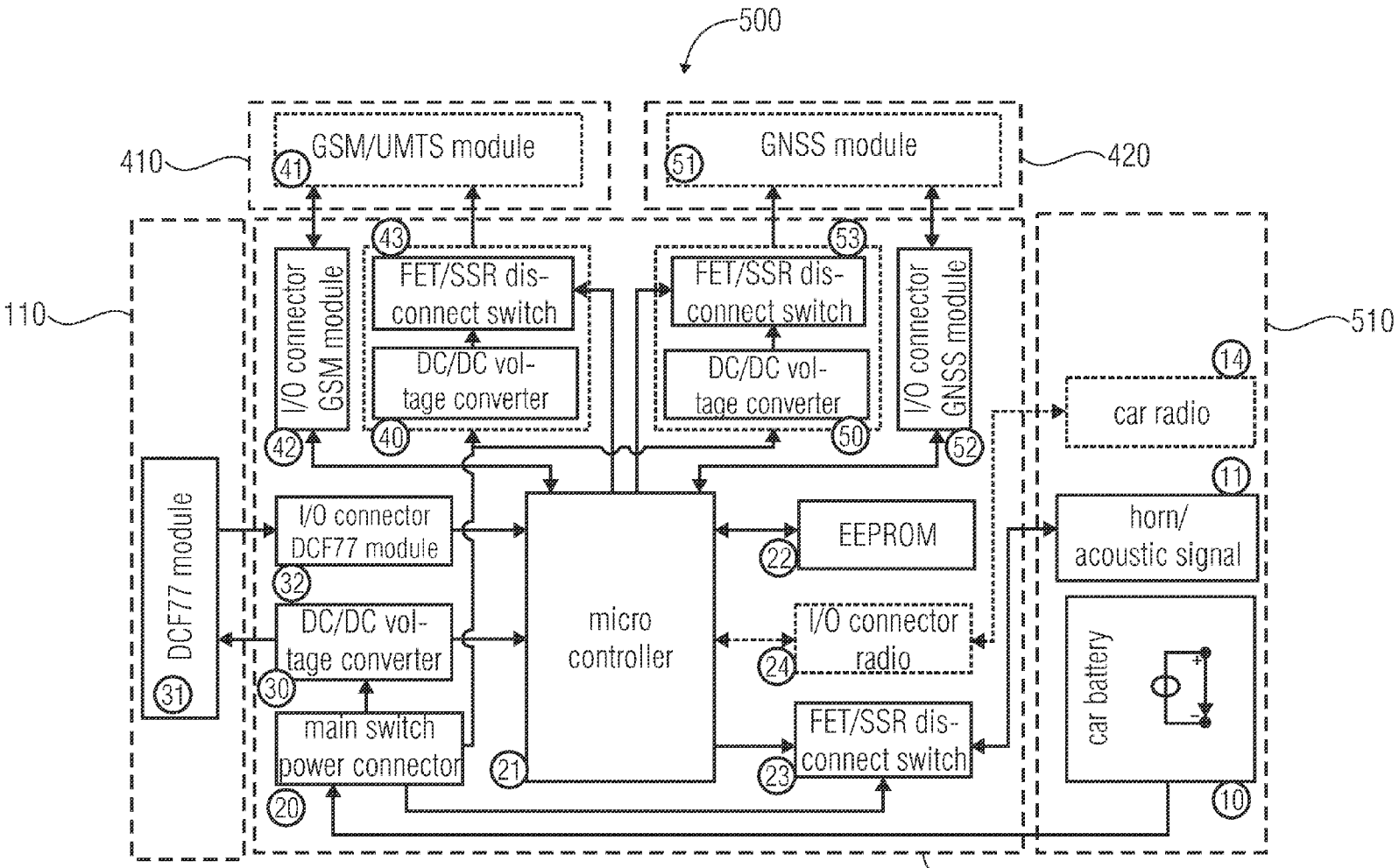
FIG. 5 is a block diagram of a device for activating the horn of a motor vehicle.

FIG. 5 shows a block diagram of a device 500 for activating the horn 11 of a motor vehicle according to an embodiment of the invention. Among other things, a basic plot of the setup of the control unit 120, also known as a control device, is illustrated.

The control device 120 includes a power supply 20 in the form of a main switch or a power connector, a microcontroller 21, a memory chip 22, like, for example, an EEPROM (electrically erasable programmable read-only memory), a switch 23 for the horn and an interface 24 for the car radio and each an FET-SSR disconnect switch 43 (field-effect transistor, solid state relay, transistor relay), a DC-DC voltage converter (direct current-direct current converter) 40 and an I/O connector (input/output) for the GSM and/or UMTS module 41, an FET/SSR disconnect switch 53, a DC-DC voltage converter 50 and an I/O connector 52 for the GNSS module 51 (global navigation satellite system) and a DC-DC voltage converter 30 and an I/O connector 32 for the receiver 110, for example for a DCF77 module 31.

The main switch 20 is connected on the one hand to the car battery 10 and on the other hand to the voltage converter 30 of the receiver 110, the voltage converter 40 of the mobile radio unit 410, the voltage converter 50 of the satellite navigation system 420 and the disconnect switch 23 of the horn 11. The overall power supply of the system may be controlled by the main switch 20.

The voltage converter 30 of the receiver 110 is connected to the DCF77 module 31 and the microcontroller 21 and may apart from the receiver 110 also supply the microcontroller 21 with the desired voltage. Alternatively, the power supply of the microcontroller 21 may also be realized via a distinct voltage converter.

The I/O connector 32 of the receiver 110 is connected to the DCF77 module 31 and the microcontroller 21 and serves for transmitting the signals (activation signal) received by the DCF77 module 31 from the receiver 110 to the microcontroller 21.

The FET/SSR disconnect switch 23 is connected to the horn 11 and serves for activating the horn 11 and the interconnected acoustic signal.

The optional I/O connector 24 is connected to the optionally existing car radio 14 and the microcontroller 21. The microcontroller 21 may, in addition, for example in case of an alarm, switch on the car radio 14 or the car radio 14 may transmit RDS (radio data system) data to the microcontroller 21.

The memory means 22 is connected to the microcontroller 21 and may, for example, store the last known position of the motor vehicle which was determined by the satellite navigation system and make the same available to the microcontroller 21 if needed.

The I/O connector of the mobile radio unit 410 is connected to the microcontroller 21 and the GSM and/or UMTS module 41 and serves as an interface for a data exchange between these two modules.

The voltage converter 40 of the mobile radio unit 410 is connected to the disconnect switch 43 which is again connected to the GMS/UMTS module 41. The voltage converter 40 serves for the energy supply of the mobile radio unit 410 which may be controlled using the disconnect switch 43.

Accordingly, the I/O connector 52, the voltage converter 50 and the disconnect switch 53 are connected to the GNSS module 51 and comprise the corresponding functionality.

Further, the microcontroller 21 is connected to the disconnect switch 23 of the horn 11, the disconnect switch 43 of the mobile radio unit 410 and the disconnect switch 53 of the satellite navigation system and may accordingly activate and control the same.

Alternatively, the energy supply 40, the interface 42 and the switch of the mobile radio module 43 may be integrated directly in the mobile radio unit 410 and the energy supply 50, the interface 52 and the switch 53 of the GNSS module may be directly integrated into the satellite navigation system 420.

Further, the energy supply 30 and the interface 32 of the DCF77 module may be part of the receiver 110.

In the illustrated example, the vehicle components 510, like the vehicle battery 10, the horn 11 and optionally the car radio 14, the control device components, like, e.g., the energy supply 20, the microcontroller 21, the memory chip 22, the switch 23 of the horn 11 and optionally the interface 24 of the car radio 14 and the DCF77 components, like, e.g., the energy supply 30, the DCF77 module 31 and the interface 32 of the DCF77 module may be regarded as basic components.

The mobile radio components, like, e.g., the energy supply 40, the mobile radio module 41, the interface 42 of the mobile radio module and the switch 43 of the mobile radio module as well as the GNSS components, like, e.g. the energy supply 50, the GNSS module 51, the interface 52 of the GNSS module and the switch 53 of the GNSS module may be regarded as additional components.

Figure 6A:
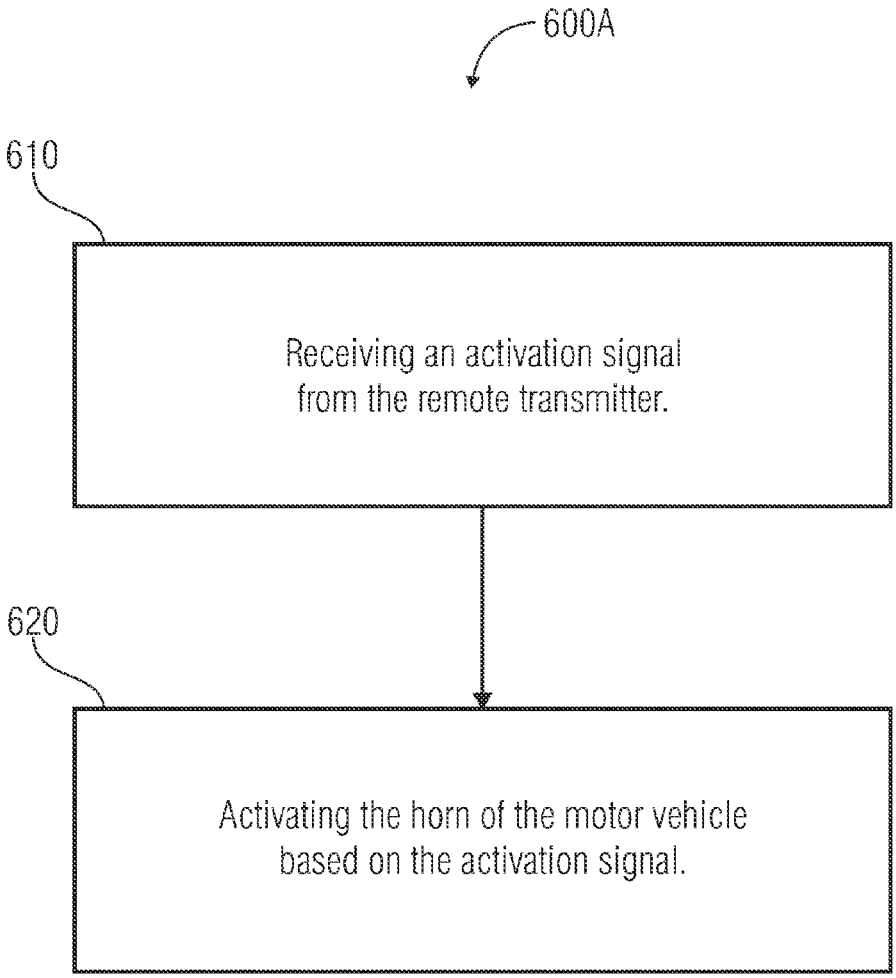
FIG. 6*a* is a flowchart of a method for activating the horn of a motor vehicle.

FIG. 6*a* shows a flowchart of a method 600*a* for activating a horn of a motor vehicle by a remote transmitter independent of a motor vehicle user according to an embodiment of the invention. The method 600*a* includes receiving 610 an activation signal from the remote transmitter and activating 620 the horn of the motor vehicle in response to the activation signal.

Figure 6B:
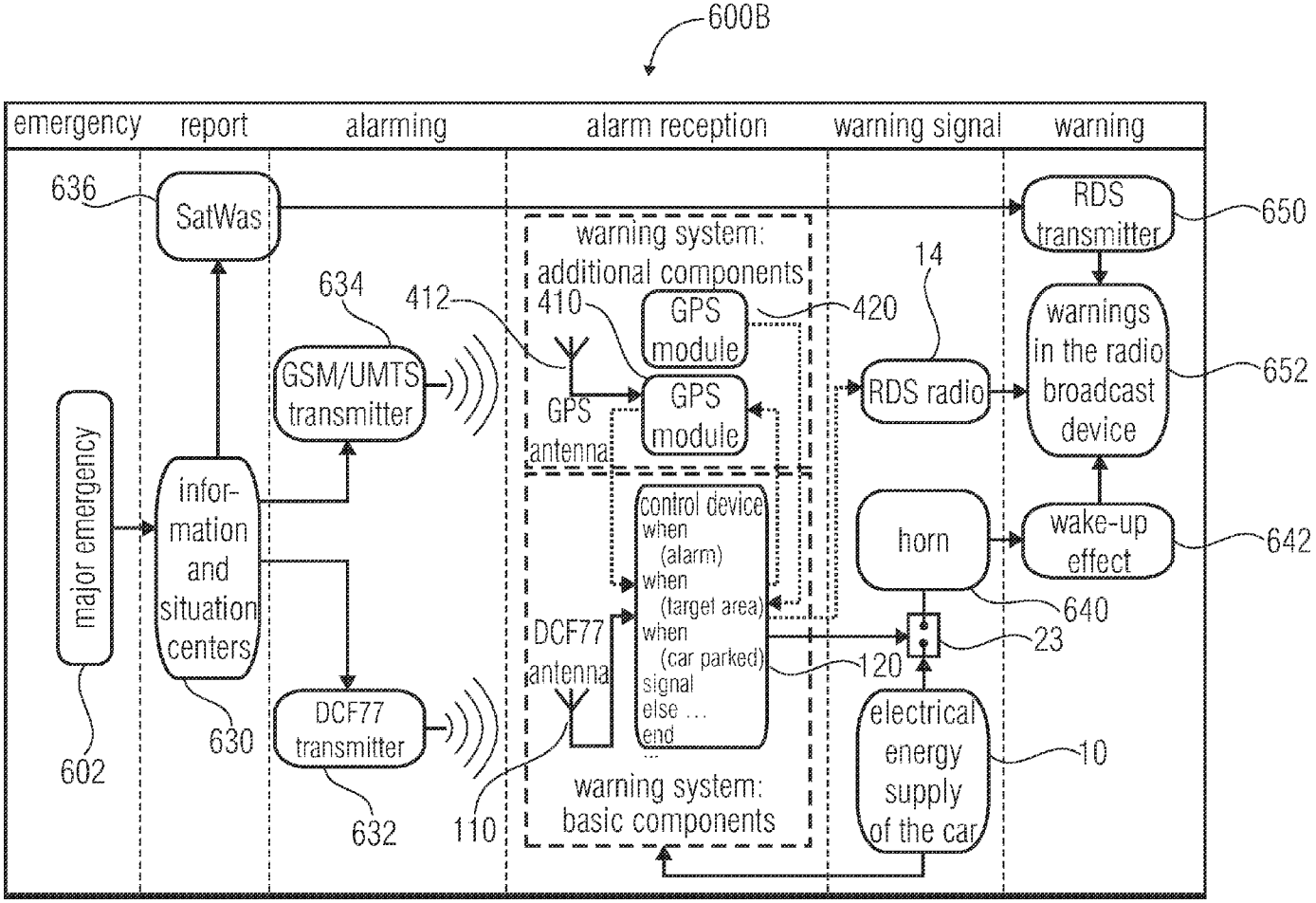
FIG. 6*b* is a flowchart of a method for alarming.

FIG. 6*b* shows a flowchart of a method 600*b* for alarming and/or warning according to one embodiment of the invention. Here, two possible variants are illustrated: on the one hand, only the DCF77 use (basic components) or extended use of mobile radio and/or GNSS modules (additional components).

If, in case of an emergency, a major emergency event 602 occurs, a message is sent to an information and situation center 630, which is, for example, connected to the DCF77 transmitter 632 and optionally to a GSM/UMTS transmitter 634 and/or a SatWas 636 (satellite-based warning system). Controlled by the information and situation center 630, an alarm is sent out which is received by the device according to the described concept using the receiver 110. The control unit or the control device 120 processes the alarm reception (the activation signal) and activates the horn of the motor vehicle via a switch 23 after checking whether, for example, an alarm is present, the vehicle is located in the target area and the vehicle is not in operation.

Optionally, the control device 120 may activate the optional GSM module 410 which may receive additional alarm information via the GSM antenna 412 and pass the same on to the control device 120. Additionally, the control device 120 may, as needed, determine the current position of the vehicle via an optional GPS module 420 (global positioning system).

If all criteria are fulfilled, the horn may be activated by the control device 120 and a warning signal in the form of honking 640 may be generated, which causes a warning message with a wake-up effect 642.

Additionally, the control device 120 may switch on an RDS radio 14 to obtain further warnings 652 via the radio device or radio. The warnings for the radio may, for example, be received by an RDS transmitter 650 which is controlled via SatWas 636 (satellite-based warning system).

Some embodiments according to the invention relate to a system for alarming the population by the activation of horns of Motor vehicles.

The horns, for example, of the motor vehicles registered in Germany, may, in case of a large-scale situation of danger or damage, be centrally and simultaneously triggered by a responsible information and situation center (MLZ; Melde- and Lagezentrum) at both state and federal levels or lower-level authorities. In other words, the transmission of the activation signal may be controlled by a control center, like, for example, a situation and information center or another central or decentral authority (e.g. a police station).

To cause a warning by motor vehicle honking by remote access, for example two technical conditions have to be fulfilled. A central transmitter or a group of decentral transmitters (e.g. electromagnetic signal) have to be available, for example, for the MLZ and a receiving unit in a motor vehicle has to trigger the warning signal, for example, depending on different parameters.

For example, the central long-wave radio transmitter DCF77 in Mainflingen (time signal transmitter of the Federal Physical-Technical Institute in Braunschweig, PTB) or comparable transmitters, widely distributed transmitters of the mobile radio providers or communication satellites may serve as transmitters. Long-wave signals like the DCF77 (signals of the DCF77) can also easily penetrate buildings (parking garages, etc.) and compact buildings. The DCF77 transmitter was already technically modified in 2003, so it can be used for the targeted activation of radio clocks in a disaster situation.

Basically, all analogue and digital, public (GSM, DCF77, RDS, etc.) and non-public radio technologies may be suitable, like, for example, radio call technologies (like pagers and other devices which, for example, use the POCSAG protocol) and trunking (TETRA, etc.).

As radio receivers, for example DCF77 modules or mobile radio modules may be used. The carrier signal of the German time transmitter DCF77 at the PTB, as already mentioned above, has already been used in a test with suitable receive modules in order to alarm radio clocks for civil protection use.

If a receiving module (for example consisting of a receiver/antenna and a control unit/control device) which reads out the complete signal data set of the DCF77 including the alarm sequence is built into vehicles according for example to the StVZO (German road traffic licensing regulation; Straβenverkehrszulassungsordnung), the horn of the vehicle may accordingly be triggered specifically.

In the first 15 bits, the encoding of the DCF77 signal contained operating information on the DCF77 control means which is not utilized by conventional radio clocks, as the time signal is exclusively transmitted in the following bits. Since the conversion in 2003, the first 14 bits for transmitting information are available for warning the population and may, for example, be already evaluated by radio clock receivers by a complete readout of the signal data set and be transmitted to the control device. A corresponding use for activating horns of motor vehicles may easily be realized.

The control device may also have other tasks apart from evaluating the signal. These include, for example, determining the vehicle state in order, for reasons of traffic safety, to trigger a signal only in vehicles which are parked. The signal sequence and duration of the warning signal or honking may depend on parameters determined in the control device. A basic synchronicity of the warning signals of all alarmed vehicles may be guaranteed by the highly accurate DCF77 time signal of the control device. Further functions, like, for example, the activation of a car radio for receiving warning messages or the activation of optical signal generators, like, for example, a hazard-warning signal flasher or an indicator of the vehicle, are possible within the range of functions of the device.

Some embodiments according to the invention offer the possibility of restricting the alarming of the population to affected areas. In other words, the activation of the horn of a motor vehicle may be carried out based on alarming area information which indicates for which area or region the alarm is intended. The alarming area information may, for example, be contained in the activation signal or in a distinct alarming area information signal.

The definition of the target area may, for example, be encoded in the first 14 bits of the radio clock data set. With respect to the encoding of the target area, different variants are possible, depending on the number of allowed cycles of the alarm code, the possible usability of the control bit 15 of today's DCF77 signal or possible future variants in which the encoding of the radio signal may, for a short time, also contain alarm information beyond the 15 bits. Primarily, the requirements of civil protection authorities with respect to the spatial resolution accuracy of the alarming zones are important with respect to position and extent.

Triggering an alarm may then depend on a positive verification of the signal in the control device as to whether the parked vehicle is located in the alarming area. In this respect, the control unit, also called control device, needs information regarding its own position. For example, in a study ordered by the federal authority responsible for civil protection (in Germany) with respect to the use of radio clocks and alarm clocks with DCF77 receivers, it was assumed that users, when buying a clock, would enter a four-digit location code into the same and update this code when changing their location (for example when going on holiday or traveling). This seems to be non-realistic when considering a spatial resolution which is to be as high as possible and with respect to handling.

The self-localization of the vehicle may be a central point for achieving a high spatial resolution and thus efficiency of the warning system. In other words, the position of the vehicle at the time of alarm ought to be known as accurately as possible, for example to activate the horns only of the motor vehicles which are located in the area at this time, the area being determined by the alarming area information.

One possibility is the evaluation of the signal strength by long-wave radio transmitters. This may, for example, either need an interface of the control device to an RDS/digital radio possibly existing in the motor vehicle or an additional antenna for the corresponding wavelength range and transmitters whose permanent availability can be relied on. The achievable resolution accuracy is low and, apart from that, depends on the quality of the information to the received transmitter locations.

Another possibility is the evaluation of the signal strength of mobile radio masts. This variant needs the additional installation of a conventional mobile radio module (e.g. GSM or UMTS standard, GSM: global system for mobile communication, UMTS: universal mobile telecommunication system). With a switched-on mobile radio module, the relative position of the vehicle with respect to transmission masts is determined from the signal strengths received from the surrounding mobile radio masts. If, for example, the cell ID of the received transmission masts can be related to location coordinates, the global position of the vehicle can be determined. This may need a table of the coordinates of all transmission masts in the area to be covered (e.g. Germany, Europe) to be stored in the control device. With transmission masts in close proximity to each other (as in conurbations), self-location may be executed with an accuracy of some hundred meters or even better. An increase in the cell ID-based accuracy is, for example, possible in rural areas by runtime trilateration between the module and the transmitters. A simplification of the method might be achieved if, for example, a method of the operator $0_2$ were to be generally applied in which, via a channel by means of cell broadcast to all mobile radio receivers, the Gauβ-Krüger coordinates of the received transmission masts are transmitted.

The mobile radio modules, for location determination, would either have to be logged in permanently, without the use of cell broadcast, or at least be switched on, with available transmitter coordinates in the cell broadcast method. Alternatively, an activation of the mobile radio module may be executed downstream to the activation of the DCF77 receiver. The alarming triggered by the DCF 77 transmitter first causes the activation of the mobile radio module by the control device. In a second step, triggering the warning signal is executed depending on the location fed back by the control device per mobile radio module.

A further possibility is the use of a GNSS module (global navigation satellite system). The highest location accuracy and the fastest determination of the location may thus be achieved. The self-localization (determination of the position of the vehicle) may be accurate to within some meters. However, signal availability may be lower than with the terrestrial radio method. This fact may, for example, be circumvented when a cyclical storage of the last determined coordinate of the GNSS module according to the FIFO principle (first in first out) is executed in the control device or in a separate storage means. If, across a certain distance, no GNSS signal can be received, for example when entering a parking garage, in tunnels or in narrow valleys, the triggering of the alarm—for example apart from checking the vehicle operation—may be made dependent on whether the last known vehicle position is within the target area. With parked cars the GNSS module may be switched off, which reduces power consumption.

This variant allows an accuracy with respect to determining the vehicle position which is higher by about one to two orders of magnitude than, for example, the possible determination of the target area using the 14-bit data set of the DCF77 signal. If the accuracy of the definition of the target area comparable to self-localization is to be achieved, this may, for example, be achieved by a larger number of alarm cycles—i.e. several series-connected 14-bit signal sequences every minute—or by the combined use of a GNSS and a mobile radio module. As the time delay of the first-mentioned method may be large, and apart from that the error probability of the signal reception may increase, a target area definition of a higher resolution ought, for example, to be based on the parallel use of GNSS and mobile radio modules, as far as the use of the DCF77 signal or of comparable transmitters remains limited to a lower data volume, like, for example, the first 15 bits.

When using a GNSS and a mobile radio module, the control device may first of all evaluate the DCF77 signal, which may here only contain a rough area default, and even when omitting any target area indications may also only transmit other control parameters (for example which vehicle types ought to react to the alarm, e.g. only authority vehicles, etc.). If an alarm is triggered and if the vehicle, according to a comparison with the last stored GNSS coordinate (or a currently determined position) is located in the rough target area, the control device activates the mobile radio module. Via a defined cell broadcasting channel—for example encoded in the DCF77 signal—the mobile radio module receives, for example, an ASCII code message, the contents of which include, for example, the exact target coordinate of the alarm area and the exact extent of the area.

Alternatively, the method may—when losing spatial resolution—be simplified, for example, by only the transmission masts contained in the roughly given target area transmitting an ID via the defined cell broadcasting channel in whose receiving area all vehicles are to send out a warning signal.

Different variants are possible, among others the activation of the mobile radio module after a DCF77 alarm reception, a subsequent reception of a cell broadcast message and further processing in the control device (control unit). Further, self-localization may be executed for example by WLAN-based methods (wireless local area network). Their reliable, extensive availability is not foreseeable in the long term. The car-to-car communication capability to be expected in the future in connection with new telematics systems theoretically has a potential for improvement with respect to local circumstances which are disadvantageous with regard to radio technology for DCF77 reception. The reception rate of DCF77 receivers, however, is 99% nationwide.

The decision for a specific setup of the system will possibly depend on the accuracies to be achieved and the different costs for the device components needed. If, as a cost-benefit basis for a comparison to the hitherto provided solutions, the proposals for the mass equipping of households with new radio alarm clocks and watches are used, the cost of which is said to be below 15€ for each modified DCF77 receive unit, this may correspond, as far as costs are concerned, to the refitting of the vehicles with a DCF77 receiving module, which, with a simultaneous performance of the vehicle-based warning system, is comparable to the reconstruction of the siren network. Here, the additional costs of the DCF77 module compared to the Overall price of a new vehicle are to be regarded as very low.

As, due to the increasingly extensive equipping of new vehicles, in particular with respect to electronic components in the field of telematics and security/safety (security systems like airbags, future eCall systems (electronic call systems), stability programs and further assistance systems, navigation systems, multimedia services), the modules proposed for the warning system will be increasingly presented ex works, the additional costs caused by the warning system are to be estimated as low. Thus, there are plans in a large majority of the EU states, including Germany, to equip every new vehicle ex works with an eCall unit as from 2010 (details of the regulation—among others a possible optional form—are still outstanding). Thus, every vehicle would have a GSM/UMTS and a GNSS module, and generally only the installation of the DCF77 receiver or another receiver and a suitable control device would have to be regarded as additional costs.

eCall is the introduction of an automatic emergency call system for motor vehicles planned by the European Union. These devices are intended to report traffic accidents to the standard European emergency number 112 and, by the rapid initiation of rescue measures, help to reduce the number of road deaths and reduce the severity of injuries in road traffic.

Here, in case of an accident an emergency call (eCall) is to be triggered which directly sends a so-called minimal data set to a central emergency switchboard, simultaneously establishing a voice connection in case a passenger of the accident vehicle is still able to talk. eCall may be triggered automatically and manually.

The minimal data set may, among other things, contain the accident time, the exact coordinates of the accident location, the driving direction, the vehicle ID, etc. Optionally, the transfer of data to board security systems is possible, such as the severity of the accident and the number of passengers, whether seatbelts were fastened, whether the vehicle overturned, etc.

The introduction of eCall needs, among other things, equipping vehicles with a GPS and GSM module, an antenna and an additional control device in which the eCall function is implemented.

As currently no extensive or nationwide warning system with a wake-up effect exists in Germany, the advantages of the described system may, for example, be compared to the different potential methods which were already the subject of examinations.

For example, the performance of the system may distinguish itself by high effectivity with a wake-up effect (at least comparable to the previous network of mechanical sirens, see annex), a high coverage (vehicles/households), a high availability (a low coverage of equipped vehicles is already sufficient to reach the population as the signals can be heard from a long distance) and a short setup phase (reproduction rate approx. 10% of the overall vehicle number per year). Additionally, the system may be used precisely in a spatially selective and, at the same time, distortion-free way.

Reliability may be guaranteed, for example, by an independence of the electricity network, a high redundancy (by millions of existing vehicles) and high technical reliability, as vehicles are inspected or renewed regularly.

No installation costs would result for the state, for example, if the system uses built-in components (car battery, horn, telematics module) and the pure additional expenditure is included in the price of the vehicle (estimated additional expenditure <15,–€/vehicle). Additionally, the system may be virtually maintenance-free in its expected useful life. No specific maintenance costs would have to be expected on the part of the state or the consumer.

The capacity for development may, for example, be guaranteed as the system may easily be expanded into a solution adapted Europe-wide and, for example, also be further developed into a traffic guidance system in case of mass evacuations. The system may be adapted with little effort, as a continuous exchange of the modules may be done by new vehicles being bought.

By the system, a warning system with an effective wake-up function for the population and simultaneously minimum installation and virtually no maintenance costs may be realized.

As the functionality of the system is based on the encoded alarming by an authority, a circumvention, for example, can be excluded.

Some further embodiments according to the invention relate to a warning system for alarming the population. The warning system may be used for alarming the population with a wake-up effect by acoustic signals.

Further application possibilities consist, for example, in the use as a warning means for moving traffic, such as, e.g., an official or regulatory guidance system in the case of mass evacuations by guiding the streams of traffic by means of warning messages or local warnings to vehicle occupants when approaching a danger spot, like, e.g., an accident, impassable roads, etc.

Some embodiments according to the invention relate to different variants for alarming.

Several variants of the system are possible, for example.

For example, a spatially unrestricted triggering of an alarm by means of DCF77 and/or GSM/UMTS may be realized.

Alternatively, for example, a locally restricted triggering of an alarm may be enabled by means of DCF77 and/or GSM/UMTS.

Further, satellite communication may be used.

A variant for a locally restricted resolution/triggering of an alarm by means of DCF77 would be, for example:

1. Emergency Occurrence of a spatially limited major emergency
2. Report Reception of the damage or emergency report at an information and situation center
3. Alarming Triggering the alarming for a limited area by means of DCF77 transmitters for default region code. In parallel to that, passing on a warning to the radio broadcasting stations cooperating with SatWas.
4. Alarm reception Reception of the alarm message by DCF77 antenna (receiver) in the vehicle. Processing the signal in the control device:
   1. Check with regard to alarm sequence
   2. Check with regard to area specification
   3. Check of the vehicle state
5. Warning signal Conditioned reaction of the system.
   When:
   1. alarm sequence found
   2. area specification correct
   3. vehicle state "parked for [default] minutes"
   Then:
   4. signal generation according to default signal scheme
   Else:
   5. no signal generation with vehicle operation
   6. automatic switching/switching on of an RDS radio on a transmitter cooperating with SatWas when current GPS coordinate is in the target area.
6. Warning Alarmed persons receive warnings of the radio broadcast stations.

A variant for a locally restricted resolution of an alarm by means of DCF77 and GSM/UMTS would be, for example:

1. Emergency See above
2. Report See above
3. Alarming Triggering the alarming for a limited area by means of DCF77 transmitters and via GSM/UMTS transmitters in cell broadcasting for default coordinates and/or extension areas. In parallel to that, passing on a warning to the radio broadcasting stations cooperating with SatWas.
4. Alarm reception Reception of the alarm message by DCF77 module. Thereupon activation of the GSM antenna. Processing the GSM signal in the control device:
   1. Checking the GSM signal with respect to alarm (=double protection)
   2. Checking with respect to area specification per last stored GPS coordinate
   3. Checking the vehicle state
5. Warning signal See above
6. Warning See above Some further embodiments according to the invention relate to a possible setup of the activation signal, also referred to as alarming signal. For the transmission of information for warning the population there is already (in Germany) an encoding scheme of 2003 using which alarms on a federal, state and area level may be distinguished. The following schemes are alternatives.

A possible content 700 with an exclusive use of the DCF77 transmitter of the PTB (binary data structure, 14-bit information content) for a coarse grid structure is illustrated in FIG. 7. Here, an area extension of Germany (width×height) of 650×900 km, a physical cell size of 25×25 km with a number of 936 cells and a cell size with a correction of 12.5×12.5 km with a number of 1,872 cells is assumed.

If the correction bit 4 is set, the center of the alarming area, for example, may in each case be offset by half a cell width in a southern and eastern direction, with respect to the cell which is addressed as bit 5-14. By this, the area resolution may be increased to double.

A possible content 800 with an exclusive use of the DCF77 transmitter of the PTB with a fine grid structure is illustrated in FIG. 8. Here, an area extension of Germany (W×H) of 1,000×1,000 km and a physical cell size of 250×250 m with a number of more than $16\times10^6$ cells is assumed.

Here, two cycles of the time signal are awaited before the alarm is triggered.

Here, for example, in the first cycle of the time signal, the x coordinate and the radii group, and in the second cycle, the y coordinate and the radius may be transmitted.

A possible content 900 of the DCF77 signal of the transmitter of the PTB when using GNSS and/or mobile radio modules (binary data structure) is illustrated in FIG. 9.

Further, a possible content 1000 of an alarming signal with an exclusive use of eCall modules by cell broadcasting according to current technical standards (ASCII data structure) is illustrated in FIG. 10.

Information on the DCF77 transmitter and its encoding are, for example, to be found on the homepage of the PTB: http://www.ptb.de/de/org/4/44/443/dcf77bbk.htm.

Some embodiments according to the invention relate to a system for alarming the population with the help of the horns of motor vehicles.

The horns of motor vehicles registered, for example, in Germany are in case of a large-area danger or emergency situation triggered simultaneously and centrally by the responsible information and situation centers on a federal or state level or by subordinate authorities, in order to alarm the population by synchronous loud honking—with a wake-up effect (!)—and to thus achieve the switching on of radio broadcast devices (TV, radio, Internet), so that the population notice the warning announcements of the civil protection authorities.

As a triggering transmitter, the central long-wave transmitter DCF77 in Mainflingen (time signal transmitter of the Physical-Technical Federal Institute in Braunschweig, PTB), or comparable transmitters may be used which serve transmitters of the mobile radio providers or communication satellites distributed nationwide.

As a radio receiver, advantageously DCF77 modules but also, e.g., mobile radio modules may be used.

Different variants are possible (see the already filed invention disclosure regarding this). The most powerful variant is coupling a receiving module to the eCall module to be integrated into each EU vehicle as from 2010, which will include a mobile radio (GSM/UMTS) and a navigation unit (GNSS, e.g. GPS, Galileo).

Some embodiments according to the invention include the following components of a warning system with a wake-up effect based on motor vehicle horns. The described method for warning the population, a system based on this method and a device controlling the system.

In the present application, for objects and functional units comprising same or similar functional characteristics partially the same reference numerals are used.

It is in particular to be noted that, depending on the circumstances, the inventive scheme may also be implemented in software. The implementation may be on a digital storage medium, in particular a floppy disc or a CD having electronically readable control signals which may cooperate with a programmable computer system so that the corresponding method is executed. In general, the invention thus also consists in a computer program product having a program code stored on a machine-readable carrier for executing the inventive method when the computer program product is executed on a computer. In other words, the invention may thus also be realized as a computer program having a program code for executing the method, when the computer program product is executed on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alteration, permutations and equivalents as fall within the true spirit and scope of the present invention.

The invention claimed is:

1. A device for activating a horn of a motor vehicle by a remote transmitter independent of a motor vehicle user, comprising:

a receiver which is implemented to receive an activation signal from the remote transmitter; and a control unit which is implemented to activate the horn of the motor vehicle in response to the activation signal, wherein the control unit, in response to the activation signal, is implemented:

to determine the motor vehicle state, to determine a position of the motor vehicle, and based on a comparison of alarming area information and the position of the motor vehicle, to activate the horn of the motor vehicle, wherein the alarming area information is comprised in the activation signal or in an alarming area information signal; and the control unit of the motor vehicle is implemented to activate the horn to warn a civilian population in case of an alarm only when the control unit has determined that the motor vehicle is parked.

2. The device according to claim 1, wherein the activation signal comprises alarm information, wherein the control unit is implemented to activate the horn of the motor vehicle based on the alarm information.

3. The device according to claim 1, wherein the control unit is further implemented to activate the horn of the motor vehicle based on a default vehicle state.

4. The device according to claim 1, comprising a mobile radio unit which is implemented to receive the alarming area information signal.

5. The device according to claim 1, comprising a mobile radio unit which is implemented to determine a position of the motor vehicle.

6. The device according to claim 1, comprising a satellite navigation system which is implemented to determine a position of the motor vehicle.

7. The device according to claim 1, including a memory for storing a last known position of the motor vehicle.

8. The device according to claim 1, wherein the motor vehicle comprises a radio and the control unit is implemented to switch on the radio based on the activation signal.

9. The device according to claim 1, wherein the motor vehicle comprises an optical signaler and the control unit is implemented to switch on the optical signaler based on the activation signal.

10. A motor vehicle comprising a device for activating a horn of a motor vehicle by a remote transmitter independent of a motor vehicle user, comprising:

a receiver which is implemented to receive an activation signal from the remote transmitter; and a control unit which, in response to the activation signal, is implemented to:

determine the motor vehicle state, to determine a position of the motor vehicle, and;

based on a comparison of alarming area information and the position of the motor vehicle, to activate the horn of the motor vehicle, wherein the alarming area information is comprised in the activation signal or in an alarming area information signal, and the control unit of the motor vehicle is implemented to activate the horn to warn a civilian population in case of an alarm only when the control unit has determined that the motor vehicle is parked.

11. An alarming system, comprising:

a motor vehicle comprising a device for activating a horn of a motor vehicle by a remote transmitter independent of a motor vehicle user, comprising:

a receiver which is implemented to receive an activation signal from the remote transmitter; and a control unit which, in response to the activation signal, is implemented to:

determine the motor vehicle state to determine a position of the motor vehicle and, based on a comparison of alarming area information and the position of the motor vehicle, and to activate the horn of the motor vehicle, wherein the alarming area information is comprised in the activation signal or in an alarming area information signal, wherein the control unit of the motor vehicle is implemented to activate the horn to warn a civilian population in case of an alarm only when the control unit has determined that the motor vehicle is parked;

a remote transmitter which is implemented to transmit the activation signal; and a control center which is implemented to control the transmission of the activation signal by the remote transmitter.

12. A method for activating a horn of a motor vehicle by a remote transmitter independent of a vehicle user, comprising:

receiving an activation signal from the remote transmitter;

determining, in response to the activation signal, the motor vehicle state, determining a position of the motor vehicle in response to the activation signal; and activating the horn of the motor vehicle, wherein the control unit of the motor vehicle is implemented to activate the horn to warn a civilian population in case of an alarm only when the control unit has determined that the motor vehicle is parked.

13. A non-transitory computer readable medium including a computer program comprising a program code for executing a method, when the computer program is executed on a computer or microcontroller, for activating a horn of a motor vehicle by a remote transmitter independent of a vehicle user, comprising:

receiving an activation signal from the remote transmitter;

determining, in response to the activation signal, the motor vehicle state, determining a position of the motor vehicle in response to the activation signal; and activating the horn of the motor vehicle, wherein the control unit of the motor vehicle is implemented to activate the horn to warn a civilian population in case of an alarm only when the control unit has determined that the motor vehicle is parked.

* * * * *